US006630940B2

(12) United States Patent
Sako

(10) Patent No.: US 6,630,940 B2
(45) Date of Patent: Oct. 7, 2003

(54) PATTERN OUTPUT CIRCUIT AND PATTERN OUTPUT METHOD

(75) Inventor: Norimitsu Sako, Chiyoda-ku (JP)

(73) Assignee: Kawasaki Steel Corporation, Kobe (JP)

( * ) Notice: Subject to any disclaimer, the term of this patent is extended or adjusted under 35 U.S.C. 154(b) by 212 days.

(21) Appl. No.: 09/919,965

(22) Filed: Aug. 2, 2001

(65) Prior Publication Data

US 2002/0044114 A1 Apr. 18, 2002

(30) Foreign Application Priority Data

Aug. 4, 2000 (JP) ..... 2000-236648

(51) Int. Cl.[7] ..... G09G 5/10

(52) U.S. Cl. ..... 345/690; 345/691; 345/99; 345/87

(58) Field of Search ..... 345/87, 89, 94, 345/98–100, 204, 690–691, 208, 211–213; 327/91

(56) References Cited

U.S. PATENT DOCUMENTS 5,414,443 A * 5/1995 Kanatani et al. ..... 345/95
5,978,929 A * 11/1999 Covino et al. ..... 713/503
6,081,144 A * 6/2000 Usuki et al. ..... 327/230
6,094,243 A * 7/2000 Yasunishi ..... 349/33
6,137,536 A * 10/2000 Yamaguchi ..... 348/521
6,177,920 B1 * 1/2001 Koyama et al. ..... 345/100
6,256,003 B1 * 7/2001 Tsuchiya et al. ..... 345/87
6,353,435 B2 * 3/2002 Kudo et al. ..... 345/204
6,476,789 B1 * 11/2002 Sakaguchi et al. ..... 345/100

* cited by examiner

*Primary Examiner*—Kent Chang
*Assistant Examiner*—Tom Sheng
(74) *Attorney, Agent, or Firm*—Oliff & Berridge, PLC

(57) ABSTRACT

The invention obtains a pattern output signal with a minimal delay time and to reduce the size of a circuit substantially. The data output from the memory is decoded and then the decoder outputs the decoded signal. Next, the pattern selection output signal is output in accordance with the decoded signal and a pattern information signal to control an ON/OFF ratio by timesharing by the pattern selection circuit. The delayed clock signal of the clock signal is generated by the delayed clock signal generating circuit, and then the pattern selection output signal is held in synchronization with the holding signal that is the difference between the clock signal and the delayed clock signal, and is output as the pattern output signal by the temporary holding circuit.

18 Claims, 6 Drawing Sheets

PATTERN OUTPUT CIRCUIT AND PATTERN OUTPUT METHOD

BACKGROUND OF THE INVENTION

1. Field of the Invention

The present invention relates to a pattern output circuit for and a pattern output method of generating a pattern output corresponding to data, by switching an ON/OFF ratio by timesharing in accordance with the data and pattern information corresponding to the data.

2. Description of the Related Art

For example, in an LCD (Liquid Crystal Display) driver, display of a sub-pixel located at an intersection of a row specified by a common driver and a column specified by a segment driver is controlled. A gray scale display is implemented by controlling timesharing, a specific ratio (pattern) for an individual sub-pixel that turns ON/OFF within a certain period of time. In a display device of a matrix mode such as an LCD and the like, a pattern output circuit is used for generating a pattern output signal that controls the gray scale display of the individual sub-pixel.

FIG. 5 is a schematic block diagram showing one example of a conventional pattern output circuit.

This pattern output circuit 52 is used in a segment driver of the LCD described above, and is formed with an address register 12, a memory 14*b*, a decoder 16, a pattern selection circuit 18 and a register 20*b*. Further, the same figure schematically shows a circuit that utilizes a pattern output signal from the pattern output circuit 52 as a rear stage circuit 24.

In the following, with reference to a timing chart shown in FIG. 6, the operation of the pattern output circuit 52 will be described.

As shown in the timing chart of FIG. 6, at first, an address signal is held in the address register 12 in synchronization with a falling edge of a clock signal CLK. The address signal held in the address register 12 is input into the memory 14*b*, and the gray scale data stored in a memory address corresponding to the address signal is output from the memory 14*b*. The decoder 16 decodes the gradation data output from the memory 14*b*.

A decoded signal output from the decoder 16 is input into the pattern selection circuit 18 along with a pattern information signal. The pattern information signal is time-series information for controlling a ratio of which the individual sub-pixel is turned ON/OFF, corresponding to each gray scale, is input into the pattern selection circuit 18 in synchronization with the falling edge of the clock signal CLK. A pattern selection output signal corresponding to the gray scale data is output from the pattern selection circuit 18, in accordance with the decoded signal and the pattern information signal.

The pattern selection output signal is held in the register 20*b* in synchronization with the falling edge of the clock signal CLK, and then output from the register 20*b* as a pattern output signal. Accordingly, the pattern output signal is delayed by one clock time-interval with respect to the pattern selection output signal, as shown in the timing chart of FIG. 6. Thereafter, the pattern output signal output from the register 20*b* is input into the rear stage circuit 24, and is utilized in synchronization with the clock signal CLK in the rear stage circuit 24.

As described above, in the conventional pattern output circuit 52, the pattern output signal is delayed by one clock time-interval with respect to the pattern selection output signal. Consequently, it cannot be used in an application which has a time limit less than the period from an input to an output and must utilize the period of the initial clock-time interval of which one cycle (Tcycle). Further, because the size of the register 20*b* is large, there is a problem with the chip size being significantly affected in an application having a large number of pattern selection output signals, such as the LCD driver, for example.

SUMMARY OF THE INVENTION

Accordingly, to solve the problems in the conventional art described above, it is an object of the present invention to provide a pattern output circuit and a pattern output method which is capable of obtaining a pattern output signal with a minimal delay time, and which is capable of significantly reducing the size of a circuit.

In order to achieve the above-mentioned objects, the present invention provides a pattern output circuit that includes a pattern selection circuit for outputting a pattern selection output signal in response to a pattern information signal to control an ON/OFF ratio by timesharing, and a temporary holding circuit for holding the pattern selection output signal and for outputting it as a pattern output signal. The temporary holding circuit holds the pattern selection output signal in synchronization with a holding signal that is the difference between a clock signal and a delayed clock signal. The delayed clock signal in this case is a delayed signal of the clock signal.

Preferably, the pattern output circuit further includes a memory for storing data, and a decoder for decoding data output from the memory and for outputting a decoded signal. The pattern selection circuit outputs the pattern selection output signal in accordance with the decoded signal and the pattern information signal.

Additionally, the pattern output circuit further includes a delayed clock signal generating circuit for generating the delayed clock signal, and a holding signal creating unit for creating the holding signal.

Still further, the delayed clock signal generating circuit includes a dummy cell having the same structure as a memory cell in the memory, and the dummy cell is provided at the furthest location away from a clock signal input terminal of the memory.

The object of the present invention can be also achieved by a pattern output circuit that includes a memory for storing data, a decoder for decoding data output from the memory and for outputting a decoded signal therefrom, a pattern selection circuit for outputting a pattern selection output signal in response to the decoded signal and a pattern information signal to control an ON/OFF ratio by timesharing, a temporary holding circuit for holding the pattern selection output signal and for outputting it as a pattern output signal, and a delayed clock signal generating circuit for generating a delayed clock signal that is a delayed signal of a clock signal. The temporary holding circuit holds the pattern selection output signal in synchronization with a holding signal that is the difference between the clock signal and the delayed clock signal.

It is preferable that in the pattern output circuit of the present invention, the temporary holding circuit includes a first transfer-gate, the pattern selection output signal being input into one of the terminals thereof, a first inverter for outputting the pattern output signal, an input thereof is connected to the other terminal of the first transfer-gate, a second inverter into which the pattern output signal is input, a second transfer-gate, an output of the second inverter is input into one of the terminals thereof, and the other terminal thereof is connected to both the other terminal of the first transfer-gate and the input of the first inverter. The first and second transfer-gates are configured so that the ON/OFF ratio thereof is controlled exclusively by the holding signal.

Preferably, in the pattern output circuit of the present invention, the temporary holding circuit further includes a pull-up transistor that the pattern output signal is input to a gate thereof, for pulling up the other terminal of the first transfer-gate and the input of the first inverter.

Additionally, in the pattern output circuit of the present invention, the temporary holding circuit includes a first transfer-gate, the pattern selection output signal being input into one of the terminals thereof, a first inverter for outputting the pattern output signal, an input thereof is connected to the other terminal of the first transfer-gate, a second inverter into which the pattern output signal is input, a second transfer-gate, an output of the second inverter is input into one of the terminals thereof, and the other terminal thereof is connected to both of the other terminal of the first transfer-gate and the input of the first inverter. The first and second transfer-gates are configured so that the ON/OFF ratio thereof is controlled exclusively by the holding signal.

The above-mentioned object of the present invention can be achieved by a pattern output circuit that includes a memory for storing data, a decoder for decoding data output from the memory and for outputting a decoded signal therefrom, a pattern selection circuit for outputting a pattern selection output signal in response to a pattern information signal to control an ON/OFF ratio by timesharing, and a temporary holding circuit for holding the pattern selection output signal and for outputting it as a pattern output signal. Additionally, when a holding signal that is the difference between a clock signal and a delayed clock signal, that is a delayed signal of the clock signal, becomes active, the temporary holding circuit holds the pattern selection output signal and is electrically separated from an output of the pattern selection circuit, and an output of the pattern selection circuit is pulled up to a power supply voltage, and a common terminal of the decoder is electrically separated from a ground. When the holding signal becomes inactive, the temporary holding circuit is electrically connected to an output of the pattern selection circuit by releasing the hold, a pull-up of an output of the pattern selection circuit is released, and a common terminal of the decoder is electrically connected to a ground.

The object of the present invention can be achieved by a pattern output method that includes the steps of outputting a pattern selection output signal in response to a pattern information signal to control an ON/OFF ratio by timesharing, and temporarily holding the pattern selection output signal in synchronization with a holding signal that is the difference between a clock signal and a delayed clock signal, which is a delayed signal of the clock signal, and outputting it as a pattern output signal.

Preferably, the pattern output method further includes the steps of reading data stored in a memory, creating a decoded signal by decoding the data, and outputting the pattern selection output signal in response to the decoded signal and the pattern information signal.

Additionally, in the pattern output method of the present invention, the delayed clock signal is fixed after the pattern selection output signal has been fixed.

Still further, in the pattern output method, the holding signal is inactive until at least the pattern selection output signal is fixed, and becomes active after at least the pattern output signal is fixed, to hold the pattern selection output signal. The above-mentioned object of the present invention can be achieved by a pattern output method that includes the steps of outputting data stored in a memory, creating a decoded signal by decoding the data, outputting a pattern selection output signal in response to the decoded signal and a pattern information signal to control an ON/OFF ratio by timesharing, and temporarily holding the pattern selection output signal in synchronization with a holding signal that is the difference between a clock signal and a delayed clock signal, which is a delayed signal of the clock signal, and outputting it as a pattern output signal.

Further objects and advantages of the invention can be more fully understood from the following detailed description taken in conjunction with the accompanying drawings.

DETAILED DESCRIPTION OF THE PREFERRED EMBODIMENTS

In the following, a pattern output circuit and a pattern output method of the present invention will be described in detail in accordance with the preferred embodiments shown in the accompanying drawings.

Figure 1:
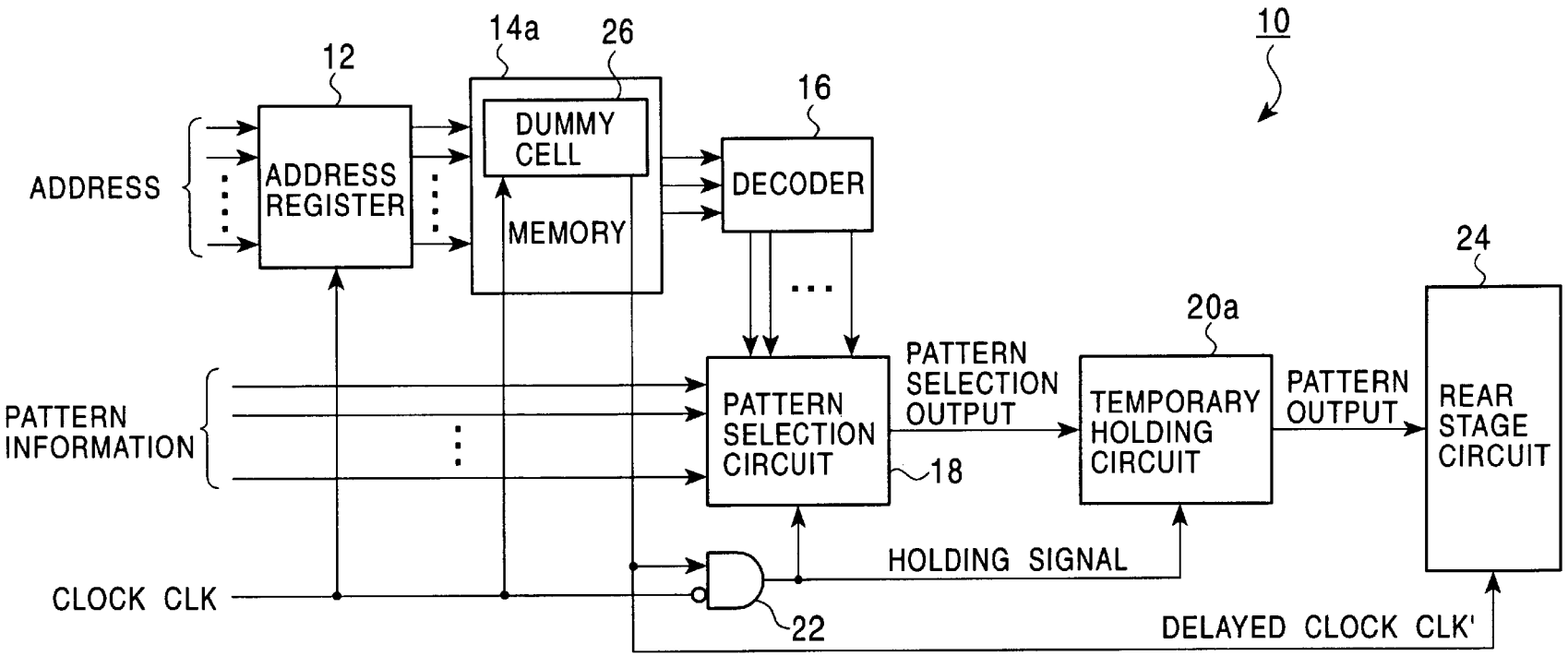
FIG. 1 is a schematic block diagram showing one embodiment of a pattern output circuit according to the present invention.

FIG. 1 is a schematic block diagram showing one embodiment of the pattern output circuit of the present invention.

The pattern output circuit 10 shown in the figure is, for example, used in a segment driver of an LCD and the like, and includes an address register 12, a memory 14*a*, a decoder 16, a pattern selection circuit 18, a temporary holding circuit 20*a*, and an AND gate 22. Further, in this figure, a circuit that utilizes a pattern output signal output from this pattern output circuit 10 is schematically shown as a rear stage circuit 24.

As shown, an address signal is input into the address register 12, and an output signal thereof is input into the memory 14*a*. An output signal of the memory 14*a*, for example, gray scale data, is input into the decoder 16, and an output signal of the decoder 16 is input into the pattern selection circuit 18 along with the pattern information signal. A pattern selection output signal output from the pattern selection circuit 18 is input into the temporary holding circuit 20*a*, and the pattern output signal output from the temporary holding circuit 20*a* is input into the rear stage circuit 24.

Further, the clock signal CLK is input into the address register 12, the memory 14*a* and one (reverse input) of the input terminals of the AND gate 22. Moreover, a delayed clock signal CLK' that the clock signal CLK is delayed, is output from the memory 14*a*, and this delayed clock signal CLK' is input into the other input terminal of the AND gate 22 and the rear stage circuit 24. A holding signal described later in more detail is output from the AND gate 22, and this holding signal is input into the pattern selection circuit 18 and the temporary holding circuit 20*a*.

As shown in FIG. 1, a dummy cell 26, which is a generating circuit for generating the delayed clock signal CLK' that the clock signal CLK is delayed, is provided inside the memory 14*a*.

Figure 2:
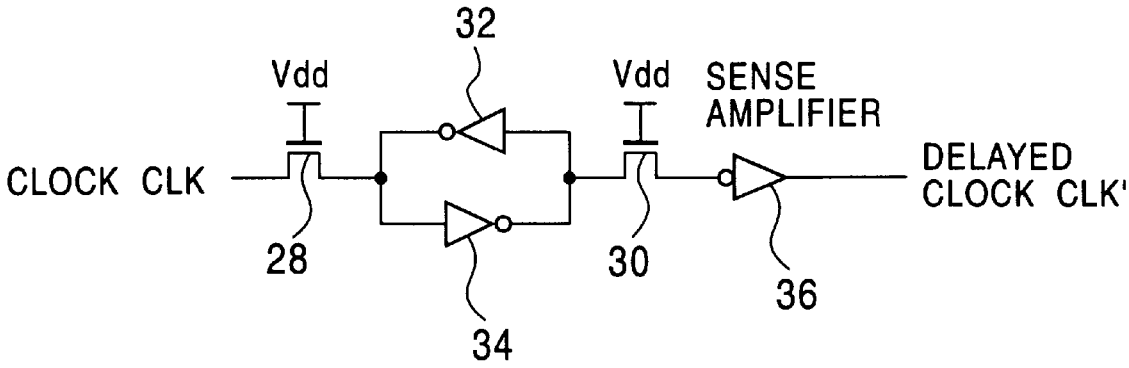
FIG. 2 is a structural circuit diagram showing one embodiment of a dummy cell.

FIG. 2 shows a concrete example of the dummy cell inside the memory 14*a*. The dummy cell 26 includes two nMOS transfer-gates 28 and 30, their gates being connected to a power supply voltage Vdd, two inverters 32 and 34 provided between the two nMOS transfer-gates 28 and 30, their mutual outputs being connected to the mutual inputs thereof in a ring shape, and a sense amplifier 36. The clock signal CLK is input into the transfer-gate 28, and the delayed clock signal CLK' is output from the transfer-gate 30 through the sense amplifier 36.

The dummy cell 26 has the same structure as the memory cell in the memory 14*a*, and is provided at the furthest location from the clock signal CLK input terminal of the memory 14*a*. The clock signal CLK is wired from the input terminal thereof to the dummy cell 26, the delayed clock signal CLK' is wired from the dummy cell 26 to a neighbor of the input terminal of the clock signal CLK, and is output from the output terminal of the delayed clock signal CLK' provided at the neighbor of that input terminal.

Accordingly, in the present embodiment, the delayed clock signal CLK' changes by being delayed more than the output signal which is finally output from one of the memory cells of the memory 14*a*. By using a dummy cell, the delayed clock signal CLK' is not affected by environmental conditions such as temperature, voltage, process variations, and the like. In other words, the delayed clock signal CLK' used in the pattern output circuit 10 of the present invention will change after the passage of prescribed time since the period when the output signal from the memory 14*a* is fixed. Specifically, the delayed clock signal CLK' will change after the pattern selection output signal is fixed.

Further, in the present embodiment, although the delayed clock signal CLK' is generated by the dummy cell 26 that is provided in the memory 14*a* and has the same structure as the memory cell, the present invention is not limited to this embodiment. For example, the delayed clock signal CLK' may be generated by using other delaying means such as a delaying circuit formed by connecting a plurality of delaying elements in series and the like. In this case with delaying elements in series, the delayed clock CLK' needs to be generated by delaying the clock signal CLK for a certain period of time and will change after the latest output signal from the memory cell is fixed.

Then, with reference to a concrete example shown in FIG. 3, the decoder 16, the pattern selection circuit 18 and the temporary holding circuit 20*a* will be described. This figure shows a circuit for generating a pattern output signal for one sub-pixel (one color) of the LCD.

At first, the decoder 16 includes the output signals GRAY2 to GRAY0 wired in the left and right directions from the memory 14*a*, the inverted signals thereof, three inverters 38, 40 and 42 that generate the inverted signals, eight signal lines (decoded signals) 7 to 0 wired in the up and down directions, and a plurality of nMOS transistors 44 provided at predetermined locations on the lattice points of the matrix formed by the output signals, the inverted signals, and the decoded signals. Further, in order to avoid complexity of the drawing, the individual transistors 44 are indicated by □.

The decoder 16 decodes the gray scale data GRAY 2 to 0 of 3 bits supplied from the memory 14*a* to generate eight signals. In the case of the example shown in the figure, only one signal line is always in an active state, such that only the signal line 0 at the right-most side is in an active state (conductive) at a time when the gray scale data GRAY 2 to 0="0" (decimal number, it is the same hereinafter), the second signal line 1 from the right side at a time when it is "1", the third signal line 2 from the right side at a time when it is "2", . . . , the signal line 7 at the most left side when it is "7".

The pattern selection circuit 18 includes a pre-charge transistor PM1, eight signal lines corresponding to the eight decoded signal lines 7 to 0 of the decoder 16 wired in the up and down directions in the figure, respectively, the pattern information signal wired in the left and right directions in the figure, eight transistors 46 provided at predetermined locations on the lattice points of the matrix formed by the eight signal lines and the pattern information signals, and a discharge transistor NM1. Further, the eight transistors 46 and the discharge transistor NM1 are also indicated by □.

A source of the pre-charge transistor PM1 is connected to the power supply voltage Vdd, and a /holding signal (an inverted signal of a holding signal) is input into a gate thereof. A drain of the pre-charge transistor PM1 is commonly connected to the drains of the eight transistors 46, and forms an output of the pattern selection output signal. The respective pattern information signals are input into the gates of the eight transistors 46, respectively, and the sources thereof are connected to the terminals of the eight signal lines 7 to 0 of the decoder 16, respectively, as shown at the upper side in FIG. 3. Further, a source of the discharge transistor NM1 is connected to the ground, and a /holding signal is input to a gate thereof A drain of the discharge transistor NM1 is commonly connected to the terminals of the eight signal lines 7 to 0 of the decoder 16, as shown at the lower side in FIG. 3.

Then, the pattern information signal is input into the pattern selection circuit 18 in synchronization with the falling edge of the clock signal CLK. The pattern information signal is time-series information for controlling a ratio (pattern) of which the individual sub-pixel in the LCD is turned ON/OFF within a certain period of time, in response to each gray scale, in other words, in response to the states of the signal lines 7 to 0 that have been decoded by the decoder 16. As described above, the pattern selection circuit 18 outputs a pattern selection output signal corresponding to a gray scale, based on the pattern information signal and the decoded signal.

For example, it is assumed that a display of one sub-pixel will be completed in seven time periods (seven cycles). In the example shown in FIG. 3, as described, only the signal line 0 at the rightmost side in the figure of the decoder 16 becomes active (conductive), when the gray scale data GRAY 2 to 0 output from the memory 14*a* is "0", i.e., the lowest gray level. The transistor 46 at the rightmost side of the pattern selection circuit 18 corresponding to this signal line 0 is always turned OFF (all seven times) by the pattern information signal.

Further, with the gray scale data GRAY2 to 0="1", for example, only the second signal line 1 from the right side of the decoder 16 becomes active. Similarly, the second transistor 46 from the right side of the pattern selection circuit 18 corresponding to this signal line 1 is controlled in accordance with the pattern information signal to be turned ON for one of the seven time periods, for example, and conversely is turned OFF for six of the seven time periods. Moreover, the same sequence is true with the cases where the gray scale data GRAY2 to 0="1" to "6".

When the gray scale data GRAY 2 to 0="7", i.e., the highest gray level, only the left-most signal line 7 of the decoder 16 becomes active. The transistor 46 on the left-most side of the pattern selection circuit 18 corresponding to this signal line 7 is controlled to be always turned ON in accordance with the pattern information signal.

As described above, in the pattern output circuit 10, in response to the gray level, the ratio of which each sub-pixel is turned ON/OFF is controlled, to implement a gray scales display corresponding to the gray scale data.

In the pattern selection circuit 18, when the holding signal is active, i.e., while the /holding signal is at a low level (the holding signal is at a high level), the pre-charge transistor PM1 is turned ON, and the discharge transistor NM1 is turned OFF. Accordingly, not only the pattern selection output signal but also all of the signal lines that are connected to the drain of the pre-charge transistor PM1 and that are electrically conductive are pre-charged.

Thereafter, when the /holding signal becomes high, the pre-charge transistor PM1 is turned OFF, and the discharge transistor NM1 is turned ON. Accordingly, all of the signal lines 7 to 0 of the decoder 16 and the signal lines of the pattern selection circuit 18 that are connected to the drain of the discharge transistor NM1 and that are electrically conductive are discharged.

At this time, the pattern selection output signal is at a floating high level if the /holding signal becomes high. Then, in accordance with the states of the decoded signal and the pattern information signal, if the drain of the pre-charge transistor PM1 and the drain of the discharge transistor NM1 are electrically conductive, the pattern selection output signal is discharged and then is at a low level. On the contrary, if the drain of the pre-charge transistor PM1 and the drain of the discharge transistor NM1 are not electrically conductive, then it maintains the floating high level.

Finally, the temporary holding circuit 20*a* includes two transfer-gates TG1, TG2, that are formed of a pMOS transistor and a nMOS transistor respectively, two inverters 48 and 50, and a pull-up pMOS transistor PM3.

The transfer-gate TG1, two inverters 48 and 50, and the transfer-gate TG2 are connected in series, in that order, and the other terminal of the transfer-gate TG2 is connected to a signal line between the transfer-gate TG1 and the inverter 48. Further, a pattern selection output signal output from the pattern selection circuit 18 is input into the other terminal of the transfer-gate TG1, and a pattern output signal is output from the inverter 48.

The holding signal is input into both of the gates of the pMOS transistor of the transfer-gate TG1 and of the NMOS transistor of the transfer-gate TG2, and on the other hand, the /holding signal is input into both of the gates of the nMOS transistor of the transfer-gate TG1 and of the pMOS transistor of the transfer-gate TG2. Further, the pull-up transistor PM3 is connected between the power supply voltage Vdd and the signal line that is between the transfer-gate TG1 and the inverter 48, and the pattern output signal that is an output signal from the inverter 48 is input into the gate thereof.

The temporary holding circuit 20*a* outputs the pattern selection output signal that is output from the pattern selection circuit as a pattern output signal while the holding signal is at a low level, and holds the state of the pattern output signal at a time when the holding signal becomes a high while the holding signal is at a high level. The pull-up transistor PM3 is for pulling up the high level of the pattern selection output signal to the power supply potential, in order to prevent the electrical potential of the signal line between the transfer-gate TG1 and the inverter 48 from becoming a floating high, at a time when the high level of the pattern selection output signal is held.

The number of transistors of this temporary holding circuit 20*a* is nine, and thus it has been reduced to less than a half of about twenty transistors, which is the number of transistors of the register 20*b* used in the conventional pattern output circuit 52. Accordingly, by using the temporary holding circuit 20*a* of the example shown in the figure, in the application of which the number of the pattern selection output signals is large, such as LCD driver, there are advantages of miniaturizing the chip size by substantially reducing the size of the circuit, and also reducing the power consumption. Further, as the temporary holding circuit 20*a*, it may be possible to utilize a register and a flip-flop and the like that are the same as in a conventional circuit.

In the following, with reference to the timing chart shown in FIG. 4, the pattern output method of the present invention, as well as the operation of the pattern output circuit of the present invention will be described.

Figure 4:
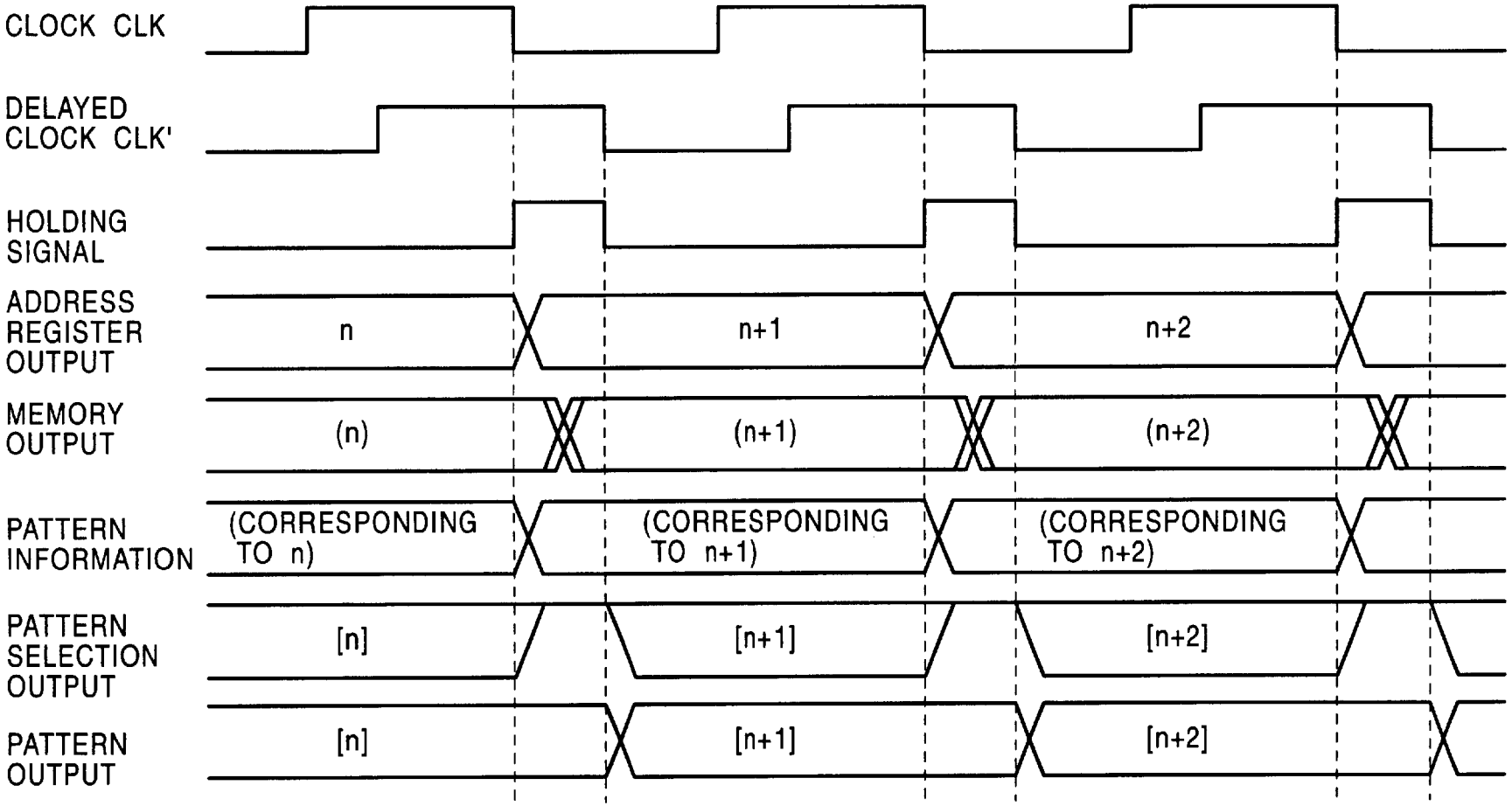
FIG. 4 is a timing-chart illustrating an operation of one embodiment of the pattern output circuit according to the present invention.
Figure 5:
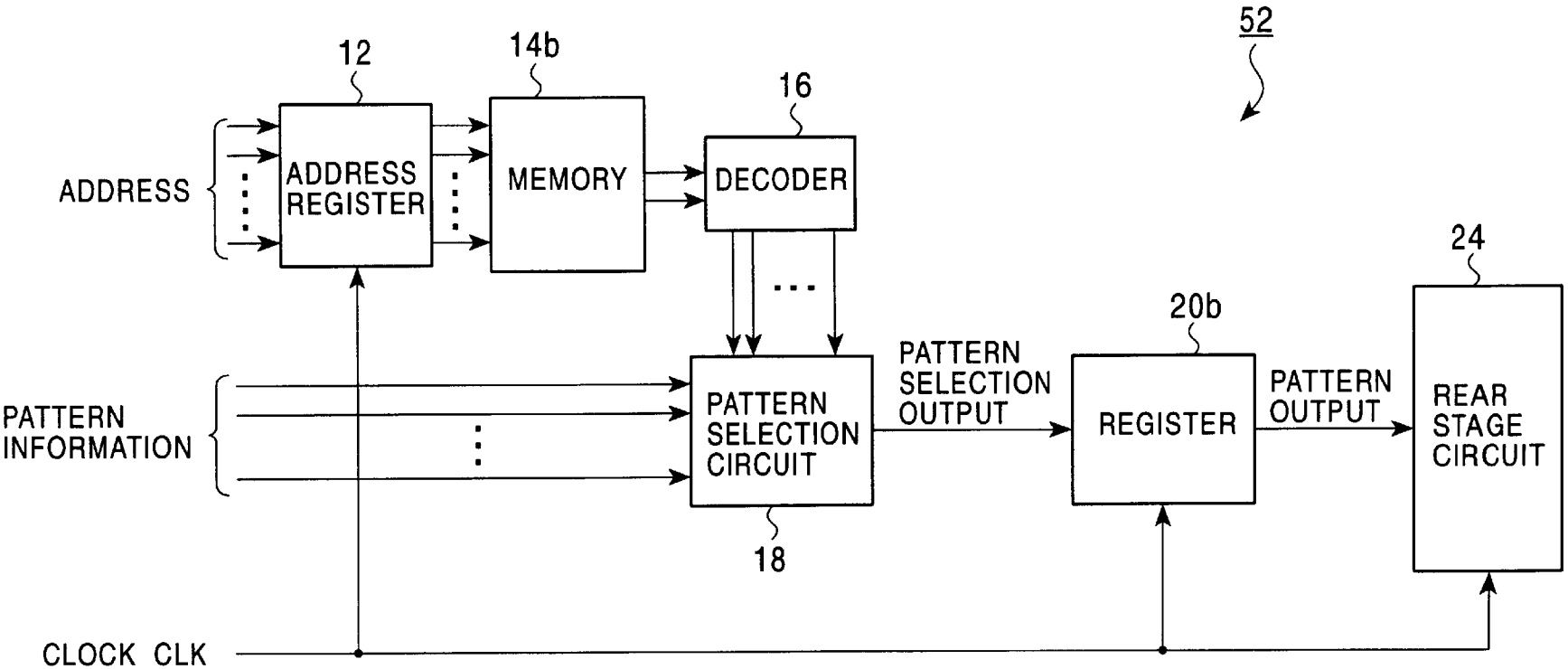
FIG. 5 PRIOR ART
FIG. 5 is a schematic block diagram of one example of a conventional pattern output circuit.
Figure 6:
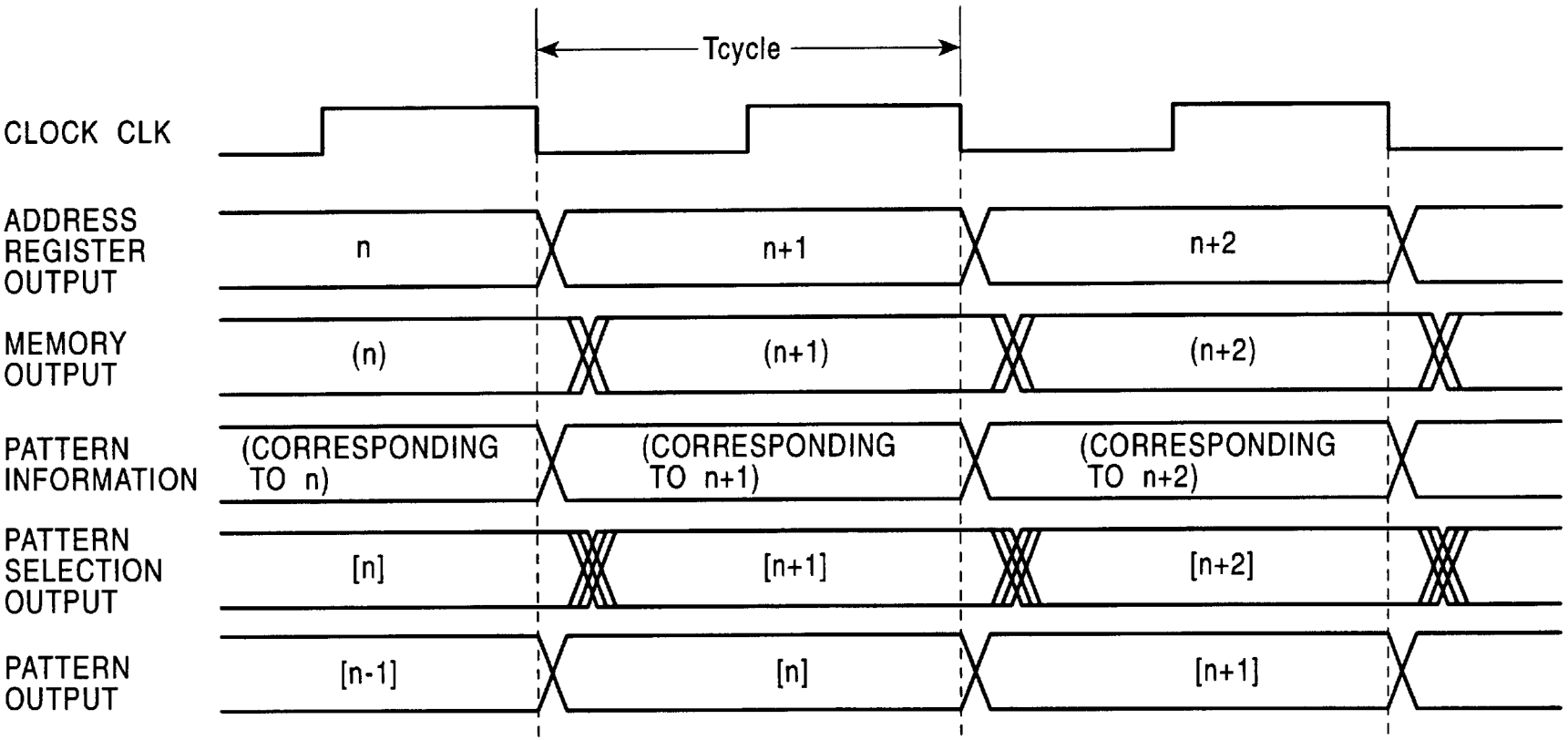
FIG. 6 is a timing-chart illustrating the operation of one example of a conventional pattern output circuit.

As shown in the timing-chart of FIG. 4, the address signal is held in the address register 12 of the pattern output circuit 10 in synchronization with the falling edge of the clock signal CLK. The address signal held in the address register 12 is input into the memory 14*a*, and the gray scale data stored in the memory address corresponding to the address signal is output from the memory 14*a* after the predetermined delay time.

Further, the clock signal CLK is input into the memory 14*a*, and the delayed clock signal CLK' delayed by the dummy cell 26 is output from the memory 14*a*. The delayed clock signal CLK' changes (edge-falls in the present embodiment) after the gray scale data output from the memory 14*a* has changed. A holding signal that is a difference between the falling edges of the clock signal CLK and the delayed clock signal CLK', respectively, is output from the AND gate 22, and is input into the pattern selection circuit 18 and the temporary holding circuit 20*a*.

The decoder 16 decodes the gray scale data output from the memory 14*a*. The decoded signal is input into the pattern selection circuit 18 along with the pattern information signal. The pattern information signal is input into the pattern selection circuit 18 in synchronization with the falling edge of the clock signal CLK. The pattern selection output signal corresponding to the gray scale is output from the pattern selection circuit 18 in accordance with the decoded signal and the pattern information signal.

The pattern selection output signal is output from the temporary holding circuit 20*a* as a pattern output signal when the holding signal is at a low level, and is held in the temporary holding circuit 20*a* when it is at a high level. Accordingly, the pattern output signal is delayed for a minimal time with respect to the pattern selection output signal, as shown in the timing-chart of FIG. 4. Thereafter, the pattern output signal output from the temporary holding circuit 20*a* is input into the rear stage circuit 24, and is utilized in synchronization with the delayed clock signal CLK' in the rear stage circuit 24.

In the pattern output circuit 10 of the present invention, the pattern output signal is delayed only for a minimal time with respect to the pattern selection output signal. In other words, the pattern output signal is output immediately after the pattern selection output signal is fixed after the output signal from the memory 14*a* is fixed.

As a result, it can be used in an application that has a time limit from an input to an output and uses a clock signal CLK of which one cycle (Tcycle) is relatively long. Also, by using the temporary holding circuit 20*a* shown in FIG. 3, in an application such as the LCD driver with a large number of the pattern selection output signals, i.e., a large number of the temporary holding circuits, it is possible to reduce the size of the circuit substantially, to miniaturize the chip size, and to reduce the power consumption.

Figure 3:
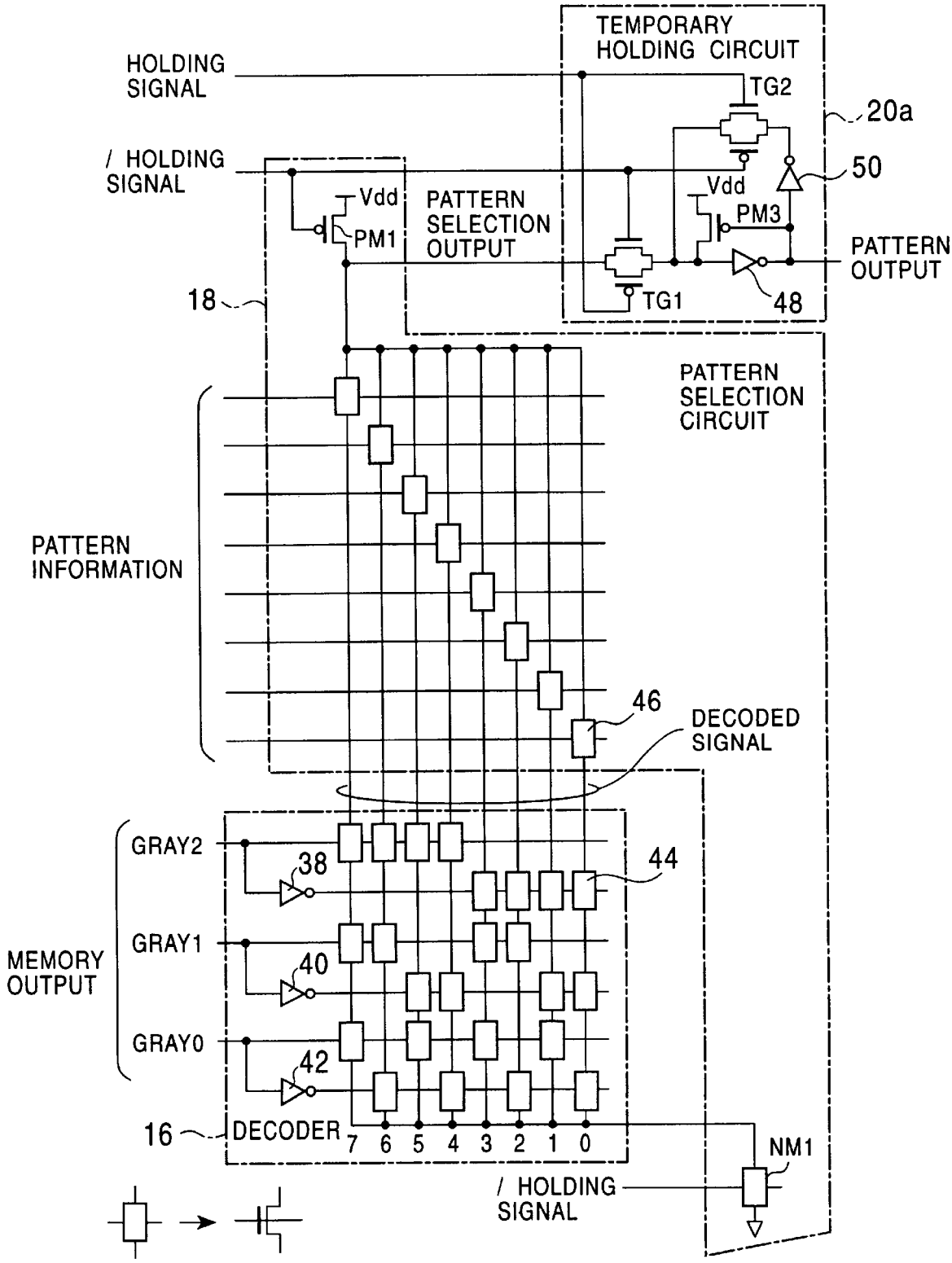
FIG. 3 is a structural circuit diagram showing one embodiment of a decoder, a pattern selection circuit, and a temporary holding circuit.

The example of FIG. 3 shows the structure of one sub-pixel (for one color) of an LCD, but in practice, several identical circuits are provided in accordance with the number of sub-pixels, the gray or color display and the like. In the pattern output circuit of the present invention, the structures of the decoder 16, pattern selection circuit 18, temporary holding circuit 20*a*, generation circuit of the delayed clock CLK' and the like are not limited to the ones shown in the figures, and other structures that implement the same functions may be used.

Moreover, the pattern output circuit 10 of the present invention is not limited to the LCD driver that controls the display of the LCD. The pattern output circuit 10 may be used for generating a pattern output signal for controlling the gray scales of the individual sub-pixels in a driver circuit to control a display of a display device in a matrix method, such as a plasma display, an EL (Electro Luminescence) display and the like. Additionally, the pattern output circuit of the present invention is also applicable to other applications that utilize the pattern output in which the ON/OFF ratios are switched by timesharing.

Accordingly, the pattern output circuit and pattern output method of the present invention are as described above.

As described above, although the pattern output circuit and pattern output method of the present invention are illustrated in detail, the present invention is not limited to the above-mentioned embodiments, and it is apparent that many improvements and modifications can be made within the scope of the present invention as defined in the following claims.

As has been described in detail, the pattern output circuit and pattern output method of the present invention are configured for decoding data and outputting the decoded signal, outputting a pattern selection output signal in accordance with the decoded signal and the pattern information signal, holding the pattern selection output signal in synchronization with the holding signal that is a difference between the clock signal and the delayed clock signal of which the clock signal is delayed, and then outputting it as the pattern output signal.

According to the pattern output circuit and pattern output method of the present invention, a stable pattern output can be obtained in a minimal delay time, by using a delayed clock that is not affected by environmental conditions and process variations. Further, according to the present invention, by using a temporary holding circuit including a smaller number of transistors, in an application that has a large number of the pattern selection output, there are advantages of a reduction in chip size and a lower power consumption.

The invention may be embodied in other specific forms without departing from the spirit or essential characteristics thereof. The present embodiments are therefore to be considered in all respects as illustrative and not restrictive, the scope of the invention being indicated by the appended claims rather than by foregoing description and all changes which come within the meaning and range of equivalency of the claims are therefore intended to be embraced therein.

What claimed is:

1. A pattern output circuit, comprising:

a pattern selection circuit that outputs a pattern selection output signal in response to a pattern information signal to control an ON/OFF ratio by timesharing; and a temporary holding circuit that holds the pattern selection output signal and outputs the pattern selection output signal as a pattern output signal, the temporary holding circuit holding the pattern selection output signal in synchronization with a holding signal that is the difference between a clock signal and a delayed clock signal, the delayed clock signal being a delayed signal of the clock signal.

2. The pattern output circuit according to claim 1, the pattern output circuit further comprising:

a memory that stores data; and a decoder that decodes data output from the memory and outputs a decoded signal, the pattern selection circuit outputting the pattern selection output signal in accordance with the decoded signal and the pattern information signal.

3. The pattern output circuit according to claim 2, the pattern output circuit further comprising:

a delayed clock signal generating circuit that generates the delayed clock signal; and a holding signal circuit that creates the holding signal.

4. The pattern output circuit according to claim 3, the delayed clock signal generating circuit further comprising a dummy cell having the same structure as a memory cell in the memory, the dummy cell being provided at the furthest location away from a clock signal input terminal of the memory.

5. The pattern output circuit according to claim 1, the pattern output circuit further comprising:

a delayed clock signal generating circuit that generates the delayed clock signal; and a holding signal circuit that creates the holding signal.

6. The pattern output circuit according to claim 1, the temporary holding circuit further comprising:

a first transfer-gate, the pattern selection output signal being input into one of the terminals thereof;

a first inverter that outputs the pattern output signal, an input of the first inverter is connected to the other terminal of the first transfer-gate;

a second inverter into which the pattern output signal is input;

a second transfer-gate, the second transfer-gate having terminals, an output of the second inverter being input into one of the terminals, another of the terminals being connected to both of the one terminal of the first transfer-gate and the input of the first inverter, the first and second transfer-gates being configured so that the ON/OFF ratio thereof being controlled exclusively by the holding signal.

7. The pattern output circuit according to claim 6, the temporary holding circuit further comprising a pull-up transistor that the pattern output signal being input to a gate thereof, and pulling up the other terminal of the first transfer-gate and the input of the first inverter.

8. A pattern output circuit, comprising:

a memory for storing data;

a decoder that decodes data output from the memory and outputs a decoded signal therefrom;

a pattern selection circuit that outputs a pattern selection output signal in response to the decoded signal and a pattern information signal to control an ON/OFF ratio by timesharing;

a temporary holding circuit that holds the pattern selection output signal and outputs the pattern selection output signal as a pattern output signal; and a delayed clock signal generating circuit that generates a delayed clock signal that is a delayed signal of a clock signal, the temporary holding circuit holding the pattern selection output signal in synchronization with a holding signal that is the difference between the clock signal and the delayed clock signal.

9. The pattern output circuit according to claim 8, the delayed clock signal generating circuit further comprising a dummy cell having the same structure as a memory cell in the memory, the dummy cell being provided at the furthest location away from a clock signal input terminal of the memory.

10. The pattern output circuit according to claim 8, the temporary holding circuit further comprising:

a first transfer-gate, the pattern selection output signal being input into one of the terminals thereof;

a first inverter that outputs the pattern output signal, an input of the first inverter is connected to the other terminal of the first transfer-gate;

a second inverter into which the pattern output signal is input;

a second transfer-gate, the second transfer-gate including terminals, an output of the second inverter being input into one of the terminals, another terminal being connected to both of the one terminal of the first transfer-gate and the input of the first inverter;

a pull-up transistor having a gate, the pattern output signal being input to the gate, and for pulling up the other terminal of the first transfer-gate and the input of the first inverter, the first and second transfer-gates being configured so that the ON/OFF ratio thereof being controlled exclusively by the holding signal.

11. A pattern output circuit, comprising:

a memory that stores data;

a decoder that decodes data output from the memory and outputs a decoded signal;

a pattern selection circuit that outputs a pattern selection output signal in response to the decoded signal and a pattern information signal to control an ON/OFF ratio by timesharing; and a temporary holding circuit that holds the pattern selection output signal and outputs the pattern selection output signal as a pattern output signal, such that, when a holding signal that is the difference between a clock signal and a delayed clock signal, which is a delayed signal of the clock signal, becomes active, the temporary holding circuit holds the pattern selection output signal and is electrically separated from an output of the pattern selection circuit, and the output of the pattern selection circuit is pulled up to a power supply voltage, and a common terminal of the decoder is electrically separated from a ground, and when the holding signal becomes inactive, the temporary holding circuit is electrically connected to the output of the pattern selection circuit by releasing the hold, the pull-up of the output of the pattern selection circuit is released, and the common terminal of the decoder is electrically connected to a ground.

12. A pattern output method, comprising the steps of:

outputting a pattern selection output signal in response to a pattern information signal to control an ON/OFF ratio by timesharing; and temporarily holding the pattern selection output signal in synchronization with a holding signal that is the difference between a clock signal and a delayed clock signal, which is a delayed signal of the clock signal, and outputting the pattern selection output signal as a pattern output signal.

13. The pattern output method according to claim 12, further comprising the steps of:

reading data stored in a memory;

creating a decoded signal by decoding the data; and outputting the pattern selection output signal in response to the decoded signal and the pattern information signal.

14. The pattern output method according to claim 13, the delayed clock signal being fixed after the pattern selection output signal has been fixed.

15. The pattern output method according to claim 14, the holding signal being active until at least the pattern selection output signal is fixed, and so as to hold the pattern selection output signal.

16. The pattern output method according to claim 13, the holding signal being active until at least the pattern selection output signal is fixed, and so as to hold the pattern selection output signal.

17. The pattern output method according to claim 12, the holding signal being active until at least the pattern selection output signal is fixed, and so as to hold the pattern selection output signal.

18. A pattern output method, comprising the steps of:

outputting data stored in a memory;

creating a decoded signal by decoding the data;

outputting a pattern selection output signal in response to the decoded signal and a pattern information signal to control an ON/OFF ratio by timesharing; and temporarily holding the pattern selection output signal in synchronization with a holding signal that is the difference between a clock signal and a delayed clock signal, which is a delayed signal of the clock signal, and outputting the pattern selection output signal as a pattern output signal.

* * * * *